US006778060B2

(12) United States Patent
Hoffmann et al.

(10) Patent No.: US 6,778,060 B2
(45) Date of Patent: Aug. 17, 2004

(54) WINDING FOR A TRANSFORMER OR A COIL AND METHOD FOR PRODUCING THE WINDING

(75) Inventors: Roland Hoffmann, Brilon (DE); Meinolf Otto, Brilon (DE); Benjamin Weber, Winterberg (DE)

(73) Assignee: ABB T&D Technologies Ltd., Zurich (CH)

( * ) Notice: Subject to any disclaimer, the term of this patent is extended or adjusted under 35 U.S.C. 154(b) by 0 days.

(21) Appl. No.: 10/304,083

(22) Filed: Nov. 25, 2002

(65) Prior Publication Data

US 2003/0098768 A1 May 29, 2003

(30) Foreign Application Priority Data

Nov. 23, 2001 (DE) ..... 101 57 590

(51) Int. Cl.[7] ..... H01F 5/00

(52) U.S. Cl. ..... 336/200; 336/223; 336/206; 29/602.1

(58) Field of Search ..... 336/200, 223, 336/206, 232; 29/602.1

(56) References Cited

U.S. PATENT DOCUMENTS 4,327,311 A * 4/1982 Wroblewski ..... 315/244
5,274,904 A * 1/1994 Proise ..... 29/602.1
5,508,674 A * 4/1996 Girgis et al. ..... 336/187
5,543,773 A * 8/1996 Evans et al. ..... 336/183
5,805,045 A * 9/1998 Henninger ..... 336/192
6,087,922 A * 7/2000 Smith ..... 336/223

FOREIGN PATENT DOCUMENTS

| | | |
|---|---|---|
| DE | 1 819 904 | 10/1960 |
| DE | 40 07 614 A1 | 9/1990 |
| DE | 692 14 094 T2 | 5/1993 |
| EP | 0 542 445 B1 | 9/1996 |

* cited by examiner

*Primary Examiner*—Anh Mai
(74) *Attorney, Agent, or Firm*—Laurence A. Greenberg; Werner H. Stemer; Ralph E. Locher

(57) ABSTRACT

A winding for a transformer or coil includes a ribbon electrical conductor and at least one ribbon insulation material layer fitted thereto or applied as ribbon material thereto. The conductor and the insulating material layer are wound to form turns around a winding core along a winding axis. The individual turns of the winding have a predetermined winding angle with respect to the winding axis. A number of turns are located axially alongside one another form one layer, and at least two radially adjacent layers of turns are provided. A first layer of turns is radially adjacent to a second layer produced by changing the winding direction by folding the electrical conductor and the insulating material layer. The total angle, which is produced by the folding, between the longitudinal direction of the ribbon insulating material in the first layer and the corresponding direction of the second layer corresponds to twice the winding angle.

10 Claims, 2 Drawing Sheets

WINDING FOR A TRANSFORMER OR A COIL AND METHOD FOR PRODUCING THE WINDING

BACKGROUND OF THE INVENTION

Field of the Invention

The invention relates to a winding for a transformer or a coil having a ribbon electrical conductor and having at least one ribbon insulation material layer that is fitted to the electrical conductor or is applied as ribbon material to the conductor, which, that is to say, the electrical conductor and the at least one ribbon insulating material layer, are wound to form turns (also referred to as windings) around a winding core along a winding axis, with the individual turns of the winding have a predetermined winding angle with respect to the winding axis of the winding core. Moreover, a number of turns that are located axially alongside one another form one layer, and at least two radially adjacent layers of turns are provided.

In generally available windings such as these for transformers or coils with a rating of more than 5 kVa, the turns are normally wound such that they lie closely alongside one another in the axial direction, thus, forming a layer of turns. However, frequently, a number of layers are also radially joined to one another and form a multilayer transformer or a multilayer coil. Where there are a number of radially adjacent layers of turns, the winding direction of the electrical conductor in one layer must be reversed at its axial end.

If the widths of the electrical conductor are comparatively narrow, the reversing process can be carried out by changing the winding angle at the axial end of the relevant layer continuously to a value of 90°, and by finally, for example, after a further half turn, changing it to the desired winding direction. Firstly, this has the disadvantage that a layer is radially thickened at the ends, and, secondly, if the conductor ribbons are comparatively broad, there is a risk of waves being formed, and of kinks being formed in the conductor ribbon. These disadvantageous effects can be further exacerbated if the conductor ribbon is comparatively thin.

In addition, comparatively large winding angles, such as those that occur by way of example in the case of windings around a comparatively small winding core, likewise promote the disadvantageous effects described initially.

SUMMARY OF THE INVENTION

It is accordingly an object of the invention to provide a winding for a transformer or a coil and method for producing the winding that overcome the hereinafore-mentioned disadvantages of the heretofore-known devices and methods of this general type and, in which, radially adjacent layers of turns can be produced in a simple manner, particularly in the case of those electrical conductors that have a tendency to the disadvantageous effects described initially.

With the foregoing and other objects in view, there is provided, in accordance with the invention, a winding for one of a transformer and a coil, including a winding core having a winding axis, a ribbon electrical conductor, at least one ribbon insulation material layer one of fitted to the electrical conductor and applied as ribbon material to the electrical conductor, the at least one ribbon insulation material layer having a longitudinal direction, the electrical conductor and the at least one ribbon insulating material layer being wound to form turns around the winding core along the winding axis, the turns forming at least two radial adjacent layers, a number of the turns located axially alongside one another forming one of the layers, individual ones of the turns having a predetermined winding angle with respect to the winding axis, a first layer of the turns being radially adjacent to a second layer of the turns, the second layer having a changed winding direction by a folding of the electrical conductor and the at least one ribbon insulating material layer, and a total angle of the folding between the longitudinal direction of the at least one ribbon insulating material in the first layer and a corresponding longitudinal direction of the second layer corresponding to twice the winding angle.

Accordingly, the invention is characterized by a first layer of turns that is radially adjacent to a second layer, which can be produced by changing the winding direction by folding the electrical conductor and the at least one ribbon insulating material layer, and in that the total angle, which is produced by the folding, between the longitudinal direction of the ribbon insulating material in the first layer and the corresponding direction of the second layer corresponds to twice the winding angle. One major advantage according to the invention is that the change in the winding direction of the electrical conductor to produce a radially adjacent further layer is not carried out as was previously normal by slowly changing the winding direction, that is to say, continuously, but by folding the electrical conductor. In such a context, the term folding means folding the electrical conductor about a straight imaginary line that extends over the width of the ribbon electrical conductor and the at least one insulating material layer. The winding direction is, accordingly, changed in a discontinuous manner, without any possibility of such stresses occurring in the side areas in the longitudinal direction of the ribbon electrical conductor as those that occurred in the past over a comparatively long longitudinal section of the electrical conductor. However, this also avoids the formation of waves and the tendency towards kinking or deformation. In principle, such an advantage can be achieved with any ribbon conductor.

In a situation where more than one insulating layer is wound together with the electrical conductor to form turns, these may be disposed both on one broad face of the electrical conductor and on both of its broad faces.

In accordance with an added feature of the invention, the turns of each of the first and second layers have a diameter, the electrical conductor has a ribbon width, and the winding angle is a characteristic winding angle selected as a function of the ribbon width and the diameter of the turns of a respective one of the first and second layers.

The risk of the formation of waves or kinks is also particularly high when the characteristic winding angle is less than about 85°. According to the invention, these described disadvantageous effects are also reliably avoided in this case. The characteristic winding angle is that angle which is chosen as a function of the ribbon width of the electrical conductor and the diameter of the turn of the relevant layer so as to ensure that the individual turns are disposed parallel to one another during the winding process, and such that such undesirable mechanical stresses in the longitudinal direction of the electrical conductor are reliably avoided.

In accordance with another feature of the invention, an insulating layer is inserted between the first layer and the second layer. In this case as well, the invention advantageously avoids the formation of waves or cracks while, furthermore, achieves the advantage of avoiding voltage flashovers between the individual layers and, furthermore, increasing the impulse withstand voltage of the layers.

In accordance with a further feature of the invention, one of the first and second layers has an axial end and the folding is disposed at the axial end.

The winding is developed according to the invention if the fold is disposed at one axial end of a layer. In principle, the electrical conductor can be folded at any axial point, for example, to produce radially adjacent layers, although these should have different axial lengths, or to produce two separate axially adjacent layers, which are disposed radially adjacent to a further layer. However, two adjacent layers are frequently intended to have the same axial length. Then, as proposed according to the invention, the fold is disposed at the axial end of one layer. Such a configuration results in a layer having an optimum active axial length.

In accordance with an additional feature of the invention, the folding has a fold angle of approximately 180°.

In accordance with yet another feature of the invention, the at least one ribbon insulation material layer is a plurality of ribbon insulation material layers, the folding has an internal area and a folding base, one of the ribbon insulating material layers is introduced at an introduction point into the internal area of the folding starting in a region adjacent the folding base, and the one ribbon insulating material layer is one of applied to the electrical conductor and fitted as ribbon insulating material to the electrical conductor from the introduction point.

In accordance with yet a further feature of the invention, the at least one ribbon insulation material layer is a plurality of ribbon insulation material layers, the folding has an internal area and a folding base, one of the ribbon insulating material layers is introduced at an introduction point into the internal area of the folding starting in a region of the folding base, and the one ribbon insulating material layer is one of applied to the electrical conductor and fitted as ribbon insulating material to the electrical conductor from the introduction point.

In accordance with yet an added feature of the invention, a specific one of the turns has a circumference and the at least one insulating material layer is folded at a point on the circumference of the specific one of the turns different than a point at which the electrical conductor is folded.

With the objects of the invention in view, there is also provided a method of winding one of a transformer and a coil, including the steps of one of fitting at least one ribbon insulation material layer to a ribbon electrical conductor and applying the at least one ribbon insulation material layer as ribbon material to the electrical conductor, winding the electrical conductor and the at least one ribbon insulating material layer to form turns around a winding core along a winding axis with a number of the turns located axially alongside one another forming one layer of at least two radial adjacent layers of turns, individual turns of the winding having a predetermined winding angle with respect to the winding axis of the winding core, and producing a second layer of turns radially adjacent a first layer of turns by changing a winding direction by folding the electrical conductor and the at least one ribbon insulating material layer, a total angle produced by the folding, between a longitudinal direction of the at least one ribbon insulating material layer in the first layer and the corresponding longitudinal direction of the second layer, corresponding to twice the winding angle.

Other features that are considered as characteristic for the invention are set forth in the appended claims.

Although the invention is illustrated and described herein as embodied in a winding for a transformer or a coil, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
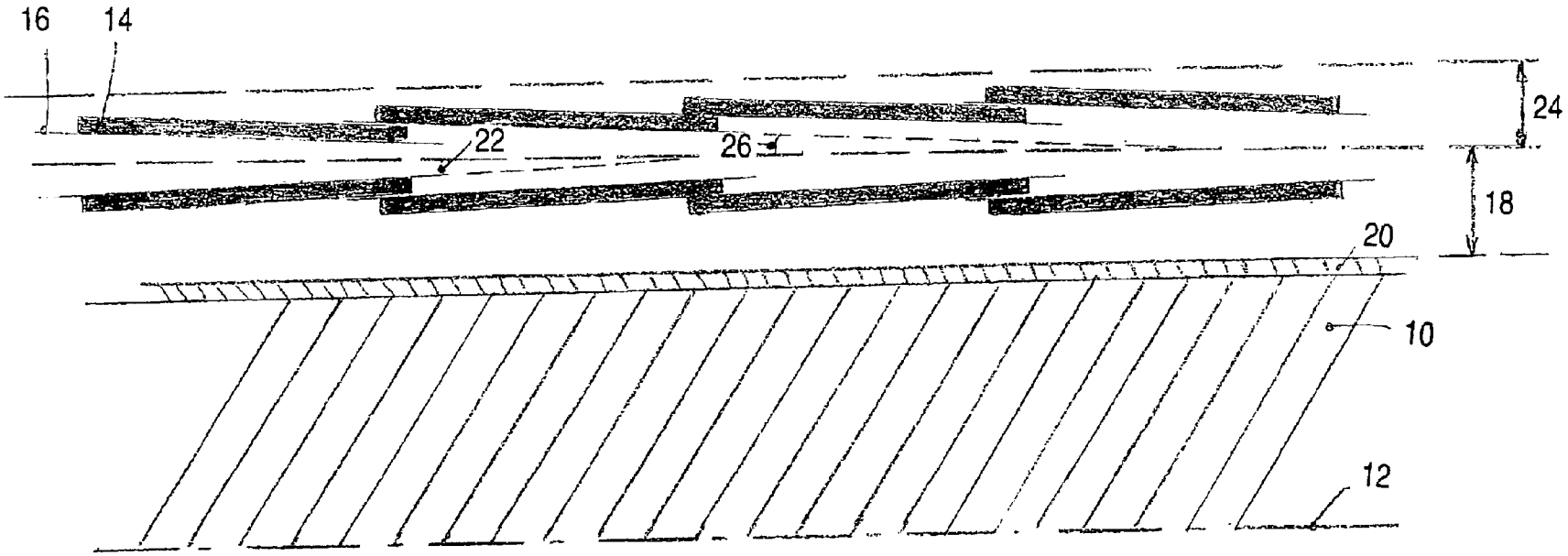
FIG. 1 is a fragmentary, cross-sectional view of a transformer winding according to the invention with two layers.

Referring now to the figures of the drawings in detail and first, particularly to FIG. 1 thereof, there is shown a detail of a two-layer winding for a transformer. The winding is wound around a winding core 10 with a winding axis 12. The winding is formed from a ribbon electrical conductor 14, which is coated with a ribbon insulation material 16. As an alternative thereto, the ribbon insulation material 16 may also be in the form of a ribbon film. Furthermore, it is irrelevant to the idea of the invention whether the electrical conductor 14 is coated with the insulation material or whether the insulation material is formed as a separate ribbon together with the electrical conductor 14 to form the winding.

The first layer 18 of turns should be that layer that is wound directly around the winding core 10. An insulating layer 20 is disposed between the first layer 18 and the winding core 10. The ribbon insulating material 16 is, in this case, disposed on that side of the electrical conductor 14 that faces away from the insulating layer 20. The individual turns in the first layer 18 are inclined through a specific angle 22 with respect to the winding axis 12. Furthermore, each turn is disposed offset by a specific amount parallel to the direction of the winding axis 12 with respect to the previous turn, such that the next subsequent turn partially overlaps the previous turn.

A second layer 24 of turns is wound radially around the first layer 18. The layer structure of the second layer 24 corresponds substantially to the layer structure of the first layer 18 so that, in this case as well, the electrical conductor 14 and the insulation material 16 are disposed in the form of a configuration of turn on turn alongside one another with a partial overlap. The overlap in the second layer 24 is chosen such that a setting angle 26 of the second layer 24 corresponds, in terms of its magnitude, to the specific angle 22, but with a negative angle orientation. This means that, from a mathematical point of view, the setting angle 26 corresponds to an angle of 180° minus the specific angle 22, assuming that the winding axis 12 is regarded as the zero angle.

Figure 2:
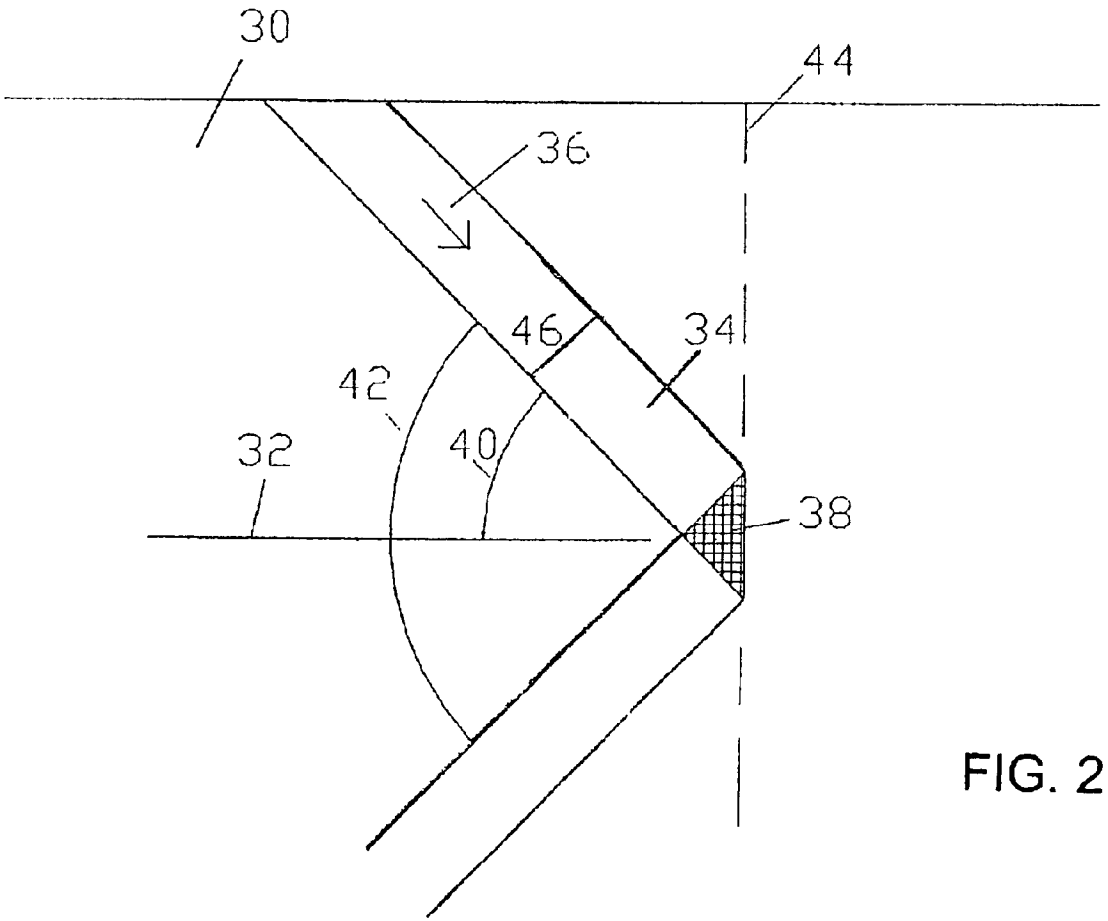
FIG. 2 is a fragmentary, plan view of the area close to a fold of a conductor ribbon according to the invention.

FIG. 2 shows a plan view of a detail of a transformer core 30, with the core axis 32 as well as a conductor ribbon 34 with the ribbon width 46. Only part of a single turn of the conductor ribbon 34 is shown. An arrow 36 indicates the direction in which the turn is intended to be wound. The arrow 36 is intended to identify that layer that is intended to be wound around the transformer core 30 at a time before a next subsequent layer and that, accordingly, ends at the fold 38. In this context, the term end means only that this layer ends at this axial point. Specifically, it is equally possible for a radially adjacent layer that is disposed further inward around the transformer core 30 not to end at this axial point, but to cover a longer axial region of the transformer core 30. In such a case, during the winding process, care must be taken to ensure that the current direction is correct and that the electromagnetic effects of the individual layers or turns do not cancel one another out.

That area of the conductor ribbon 34 that has just been described has a winding angle 40 with respect to the core axis 32. In this example, the winding angle 40 is intended to be the characteristic angle of this transformer core 30. The characteristic angle is dependent on the ribbon width 46 of the conductor ribbon 34 and on the diameter of the turn and, accordingly, is directly dependent on the geometry of the transformer core 30. If the characteristic angle is chosen as the winding angle 40, this ensures that each turn that is wound on the transformer core 30 is disposed parallel to the turn preceding it.

Typical ribbon widths 46 for a conductor ribbon 34 are between 20 mm and 150 mm, while a typical ribbon thickness for the conductor ribbon is about 0.1 mm to about 1 mm. In such a case, the ribbon width and ribbon thickness pairings are not necessarily unique. In fact, depending on the load on it, a conductor ribbon with a ribbon width of 100 mm may be configured either with a ribbon thickness of 1 mm or with a ribbon thickness of 0.1 mm. In precisely the same way, the ribbon thickness for a ribbon width of 20 mm may be 0.1 mm, 0.5 mm, or 1 mm. Furthermore, any other combination of widths and thicknesses may be chosen within the scope of the invention. The advantages according to the invention can still be achieved with other pairings.

The axial winding direction of the conductor ribbon 34 is intended to be changed at a specific point, which is indicated by a dashed line 44 here. This is done by folding the electrical conductor ribbon 34 and an insulating film that is associated with the conductor ribbon 34, although this is not shown in greater detail in this view. The folding is carried out over the entire width of the conductor ribbon 34 along a straight line that is axially coincident with the dashed line 44.

Furthermore, the fold 38 has a folding angle of approximately 180° so that, after the folding process, that side of the conductor ribbon 34 that was originally radially on the outside becomes the radially inner side, that is to say, it is the side of the conductor ribbon 34 facing the transformer core 30. The total angle 42 between the longitudinal direction of the conductor ribbon 34 before the fold 38 and the longitudinal direction of the conductor ribbon 34 after the fold 38 corresponds precisely to twice the winding angle 40. The position of the fold 38 is, thus, not only the end of one specific layer but also the start of the next subsequent layer of turns. In contrast to the situation with normal windings in the past, the change in the winding direction takes place in a discontinuous manner at the fold point. From experience, the fold 38 itself does not result in any unacceptable load on the material of the conductor ribbon 34.

However, it is also possible, for example, to fold a conductor film or an insulation film separately in the manner described initially, in particular, by the insulation film being folded directly alongside the conductor film in the circumferential direction. As such, the insulation layer that is located above or below the conductor film is also, once again, disposed underneath or above the conductor in the next layer after the folding process.

We claim:

1. A winding for one of a transformer and a coil, comprising:

a winding core having a winding axis;

a ribbon electrical conductor;

at least one ribbon insulation material layer one of fitted to said electrical conductor and applied as ribbon material to said electrical conductor, said at least one ribbon insulation material layer having a longitudinal direction;

said electrical conductor and said at least one ribbon insulating material layer being wound to form turns around said winding core along said winding axis, said turns forming at least two radial adjacent layers, a number of said turns located axially alongside one another forming one of said layers, individual ones of said turns having a predetermined winding angle with respect to said winding axis, a first layer of said turns being radially adjacent to a second layer of said turns, said second layer having a changed winding direction by a folding of said electrical conductor and said at least one ribbon insulating material layer; and a total angle of said folding between said longitudinal direction of said at least one ribbon insulating material in said first layer and a corresponding longitudinal direction of said second layer corresponding to twice said winding angle.

2. The winding according to claim 1, including an insulating layer disposed between said first layer and said second layer.

3. The winding according to claim 1, wherein:

one of said first and second layers has an axial end; and said folding is disposed at said axial end.

4. The winding according to claim 1, wherein:

said turns of each of said first and second layers have a diameter;

said electrical conductor has a ribbon width; and said winding angle is a characteristic winding angle selected as a function of said ribbon width and said diameter of said turns of a respective one of said first and second layers.

5. The winding according to claim 4, wherein said characteristic winding angle is less than approximately 85°.

6. The winding according to claim 1, wherein:

said at least one ribbon insulation material layer is a plurality of ribbon insulation material layers;

said folding has an internal area and a folding base;

one of said ribbon insulating material layers is introduced at an introduction point into said internal area of said folding starting in a region adjacent said folding base; and said one ribbon insulating material layer is one of applied to said electrical conductor and fitted as ribbon insulating material to said electrical conductor from said introduction point.

7. The winding according to claim 1, wherein:

said at least one ribbon insulation material layer is a plurality of ribbon insulation material layers;

said folding has an internal area and a folding base;

one of said ribbon insulating material layers is introduced at an introduction point into said internal area of said folding starting in a region of said folding base; and said one ribbon insulating material layer is one of applied to said electrical conductor and fitted as ribbon insulating material to said electrical conductor from said introduction point.

8. The winding according to claim 1, wherein said folding has a fold angle of approximately 180°.

9. The winding according to claim 1, wherein:

a specific one of said turns has a circumference; and said at least one insulating material layer is folded at a point on said circumference of said specific one of said turns different than a point at which said electrical conductor is folded.

10. A method of winding one of a transformer and a coil, which comprises:

one of:

fitting at least one ribbon insulation material layer to a ribbon electrical conductor; and applying the at least one ribbon insulation material layer as ribbon material to the electrical conductor;

winding the electrical conductor and the at least one ribbon insulating material layer to form turns around a winding core along a winding axis with a number of the turns located axially alongside one another forming one layer of at least two radial adjacent layers of turns, individual turns of the winding having a predetermined winding angle with respect to the winding axis of the winding core; and producing a second layer of turns radially adjacent a first layer of turns by changing a winding direction by folding the electrical conductor and the at least one ribbon insulating material layer, a total angle produced by the folding, between a longitudinal direction of the at least one ribbon insulating material layer in the first layer and the corresponding longitudinal direction of the second layer, corresponding to twice the winding angle.

* * * * *